United States Patent [19]

Takayanagi et al.

[11] Patent Number: 4,557,316

[45] Date of Patent: Dec. 10, 1985

[54] METHOD FOR MANUFACTURE OF INVESTMENT SHELL MOLD SUITABLE FOR CASTING GRAIN-ORIENTED SUPER ALLOY

[75] Inventors: Takeshi Takayanagi, Yatomimachi; Shizuo Suzuki; Susumu Minowa, both of Nagoya; Yoshihiko Nozaki, Seto, all of Japan

[73] Assignees: Agency of Industrial Science & Technology; Ministry of International Trade & Industry, both of Tokyo, Japan

[21] Appl. No.: 625,895

[22] Filed: Jun. 29, 1984

[51] Int. Cl.[4] ..... B22C 1/04

[52] U.S. Cl. ..... 164/517; 164/519; 164/138; 164/34; 164/35; 106/38.23

[58] Field of Search ..... 164/34, 35, 516–519, 164/138; 106/38.23

[56] References Cited

FOREIGN PATENT DOCUMENTS 51-87422 7/1976 Japan ..... 106/38.23

*Primary Examiner*—Kuang Y. Lin

*Attorney, Agent, or Firm*—Oblon, Fisher, Spivak, McClelland & Maier

[57] ABSTRACT

A method for the manufacture of an investment shell mold is disclosed which comprises applying to the surface of a wax pattern at least one layer of slurry formed by dissolving in an organic solvent a soluble organic cellulose derivative containing a dispersed metallic oxide, subsequenty applying to the first layer at least one layer of slurry formed by mixing a refractory powder with a cellulose binder, and thereafter causing the applied slurry layers to set and removing the pattern by the ordinary method.

3 Claims, 1 Drawing Figure

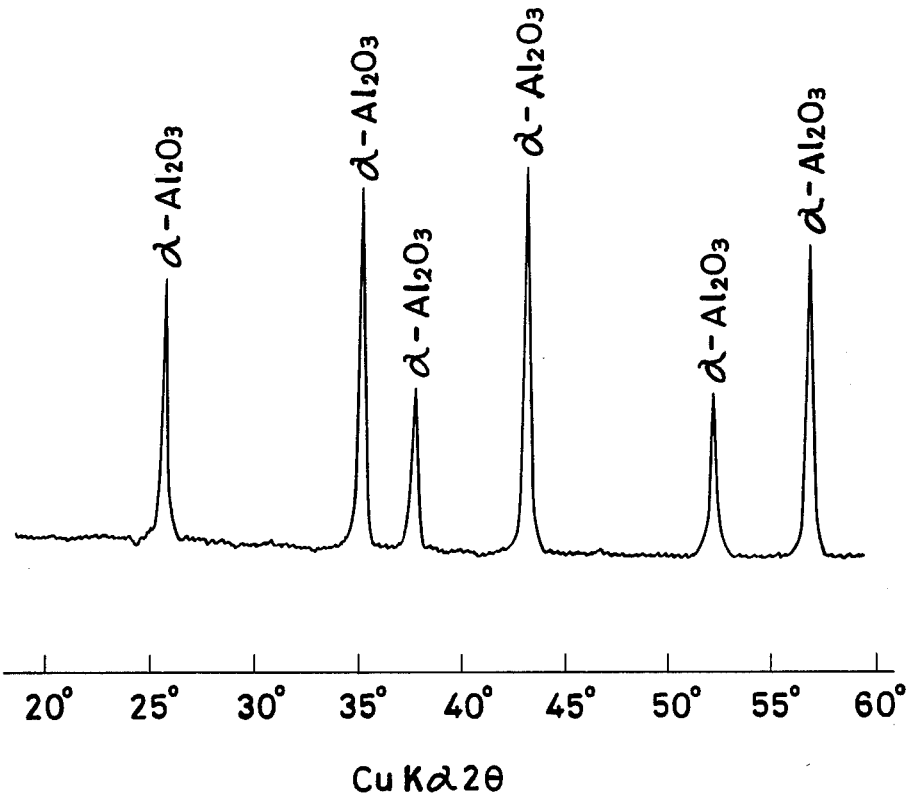
α-Al2O3
α-Al2O3
α-Al2O3
α-Al2O3
α-Al2O3
α-Al2O3
20°
25°
30°
35°
40°
45°
50°
55°
60°
Cu Kα 2θ

METHOD FOR MANUFACTURE OF INVESTMENT SHELL MOLD SUITABLE FOR CASTING GRAIN-ORIENTED SUPER ALLOY

BACKGROUND OF THE INVENTION

This invention relates to a method for the manufacture of an investment shell mold into which an alloy composition is to be cast for producing a super alloy which consists mainly of nickel or cobalt and which has the grains of its crystal structure oriented in a single direction.

Heretofore, investment molds have been manufactured by the embedding method or the shell method. This invention pertains to the investment mold by the shell method. Generally, this mold is produced by applying to the surface of a pattern formed of a soluble substance like wax or an inflammable substance a layer of slurry obtained by adding colloidal silica or ethyl silicate hydrolyzate, for example, as a binder to a refractory powder such as alumina, zirconia, or fused silica and, after the applied layers have set, removing the pattern by melting or burning. The mold thus produced is mostly used for precision casting of metallic materials which are complicated in shape or difficult to cut.

The mold manufactured by the method of this invention is suitable for production of super alloys made up of grain-oriented crystals as described above. The reason for this suitability is as follows.

In the production of super alloys, various efforts have been made to impart to these alloys with improved mechanical strength as by controlling, while the molten super alloy composition is in the process of being cooled to be set, the conditions of cooling thereby causing the alloy to solidify with the crystal thereof oriented in one direction. These efforts have resulted in development of various grain-oriented solidified super alloys. A typical alloy composition is shown below. In Ni-based grain-oriented solidified super alloys, such highly active elements as Al, Tl, Mo, W, and Ta are included for the purpose of fortifying the matrix and enabling formation of high-temperature hardening phase.

| Typical composition of grain-oriented solidified Ni—based super alloy | | | | | | |
|---|---|---|---|---|---|---|
| Cr | Mo | W | Al | Ti | Ta | Ni |
| 9.0 | 1.0 | 10.5 | 5.8 | 1.2 | 3.3 | Bal. |

For the purpose of casting an alloy composition containing such highly active elements as described above to produce a casting made up of crystal grains oriented in a single direction, however, the investment mold obtained by the conventional shell method is unsuitable because it produces free silica.

The reason for this will be explained in more detail.

When the mold is manufactured, the silica contained in the coating material as a binder collects on the cavity surface of the completed mold. Then, when the mold having silica on its cavity is used for solidifying the molten alloy composition into a grain-oriented alloy, the silica reacts with the active elements of the alloy, thus changing the composition of the alloy. It also tends to prevent the formation of grains oriented in a single direction.

To preclude this problem, therefore, the cavity face of the mold is required to be formed of a refractory substance virtually incapable of reacting with the alloy components even when the face is exposed to contact with the molten alloy composition. In the production of the conventional investment shell mold, therefore, there has been applied to the cavity face a face coating of a slurry obtained by combining a refractory powder such as alumina and a binder such as colloidal silica or ethyl silicate hydrolyzate.

This method, however, has the disadvantage that free silica nevertheless finds its way to the cavity face.

An object of this invention is to provide a method for the manufacture of an investment shell mold in which free silica does not appear on the cavity face and, therefore, which is suitable for the production of a grain-oriented solidified super alloy.

SUMMARY OF THE INVENTION

With a view to attaining the object described above, the inventors sought a method capable of producing an investment shell mold of high strength possessing a cavity face inactive to the molten alloy composition. They consequently found that the object is accomplished by a method for the manufacture of an investment shell mold by the steps of applying to the surface of a pattern of a soluble or inflammable substance slurries containing refractory substances thereby forming coating of the slurry on the pattern, causing the coating to set and, after the coating has set, removing the pattern, which method is characterized by forming the aforementioned coating by first applying to the surface of the pattern at least one layer of a slurry obtained by dissolving in an organic solvent solution of an organic soluble cellulose derivative the powder of the oxide of at least one element selected from the group consisting of magnesium, aluminum, zirconium, hafnium, yttrium, calcium, lanthanum, cesium, barium, and silicon and subsequently applying to the first layer at least one layer of a slurry formed by mixing a refractory powder and a cellulose binder.

BRIEF DESCRIPTION OF THE DRAWING

The drawing is an X-ray diffraction chart obtained of the cavity face of an investment shell mold of this invention described in Examples 1–2.

DESCRIPTION OF THE PREFERRED EMBODIMENTS

The mold to be manufactured by the method of this invention has, on the cavity face side thereof exposed to the molten super alloy, a protective layer formed of one single member of a mixture of two or more members selected from the group consisting of MgO, $Al_2O_3$, $ZrO_2$, $HfO_2$, $Y_2O_3$, CaO, $La_2O_3$, $CeO_2$, BaO and $SiO_2$, which are virtually incapable of reacting with the element of molten super alloy. It is an investment shell mold made to have sufficient strength to withstand the pressure exerted by the molten alloy.

The oxides, namely, MgO, $Al_2O_3$, $ZrO_2$, $HfO_2$, $Y_2O_3$, CaO, $La_2O_3$, $CeO_2$, BaO and $SiO_2$, usable in this invention have been selected because they hardly react at all with such highly active elements as Al, Ti, Mo, and W contained in the molten alloy composition and are almost totally free of toxicity. One member or a mixture of two or more members selected from the group mentioned above may be used in unmodified form. Preferably, they are used in the form of complex oxide such as, for example, a complex oxide of $SiO_2$ with some other oxide.

A preferred example of the organic soluble cellulose derivative is ethyl cellulose having an ethoxy group content of 43 to 50% or methyl cellulose having a methoxy group content of 38 to 43%. As the organic solvent, there is used an alcohol having no toxicity. A preferred example is ethyl alcohol.

The cellulose derivative is dissolved and further the metal oxide is dispersed in the organic solvent described above to produce a slurry. This slurry is applied to the surface of a pattern formed of a soluble substance like wax or an inflammable substance to form the first layer.

The slurry mentioned above is desired to have a solids content in the range of 1500 g/liter to 3000 g/liter. The weight of the organic solvent cellulose derivative in the organic solvent is desired to fall in the range of 2 g/liter to 10 g/liter.

The slurry concentration is desired to fall in the range of 15 to 20 seconds as measured by Zahn Cup No. 5 in accordance with ASTM. The proportion of the weight of the organic soluble cellulose derivative in the organic solvent is desired to fall in the range of 0.0008 to 0.004% based on the total weight of the slurry.

The second layer and any subsequent layers are formed by applying a slurry which is obtained by mixing a refractory powder such as MgO, $Al_2O_3$, $ZrO_2$.-$SiO_2$, $SiO_2$ or CaO and a binder such as colloidal silica or ethyl silicate hydrolyzate.

Then, the resultant superposed slurry layers are set by being dried and, when necessary, heated by the ordinary method. The inner pattern is removed from the formed shell by being melted or burned by the ordinary method. Consequently, there is obtained the mold.

During the course of this treatment, first the organic solvent and then the cellulose derivative are removed from the first layer by the firing. Consequently, in the first layer of the mold, namely the cavity face (face coat side) destined to be exposed to the molten alloy composition, there is formed a protective layer formed of one member or a mixture of two or more members selected from the group consisting of MgO, $Al_2O_3$, $ZrO_2$, $HfO_2$, $Y_2O_3$, CaO, $La_2O_3$, $CeO_2$, BaO and $SiO_2$. The formation of this protective layer does not impair the strength of the mold.

In the investment shell mold manufactured as described above, therefore, the Ni-based or Co-based super alloy containing such highly active elements as Al, Ti, Mo, and W can be effectively cast to produce a grain-oriented solidified casting.

Although the mold according to this invention is especially effective in the casting of a Ni-based or Co-based super alloy, it can naturally be used for casting other super alloys as well.

Now, working examples of this invention will be cited below.

EXAMPLE 1

(1) Slurry composition for face coat (first layer)

Alcohol 2.5% ethyl cellulose (ethoxy group content 49%) solution: 100 cc $Al_2O_3$ powder (purity 99.6%, particle size 7–8 μm): 230 g (2) Slurry composition for second and subsequent layers Colloidal silica: 100 cc $Al_2O_3$: 200 g (3) Stucco material For first and second layers—$Al_2O_3$ particles: (210–250 μm)

For third to seventh layers—$Al_2O_3$ particles (297–350 μm)

The first-layer stucco material was coated on the surface of a pattern formed of wax, the first-layer slurry was applied thereto, and the second to seventh-layer slurry were sucessively superposed thereon as severally interposed by the layer of the stucco material.

The superposed slurry layers thus formed to surround the pattern were dried and burnt to produce an investment shell mold.

EXAMPLE 2

The procedure of Example 1 was repeated, except that the slurry composition for the second subsequent layers indicated below were used in the place of that used in Example 1.

Slurry composition for second and subsequently layers

Ethyl silicate hydrolyzate: 100 cc $Al_2O_3$ powder: 200 g

The molds obtained in Examples 1–2, after being dried and fired, were tested for strength. The cavity faces of these molds (face coat side) destined to exposure to the molten alloy composition were analyzed by X-ray diffraction. The results are shown in a graph.

Bending strength of mold after drying and firing

| | Trearing Conditions | | |
|---|---|---|---|
| | Drying (Kg · f/cm²) | Firing at 800° C. × 2 hours (Kg · f/cm²) | Firing at 1200° C. 2 hours (Kg · f/cm²) |
| Example 1 | 52.6 | 77.0 | 180.0 |
| Example 2 | 22.1 | 23.0 | 83.6 |

It is noted from the results of the test for bending strength given above that the investment shell molds produced in accordance with this invention are capable of amply withstanding the pressure of the molten alloy composition. The accompanying X-ray diffraction diagram represents the data obtained of the cavity faces of the molds obtained in the working examples. These data indicate that these cavity faces were wholly formed of $\alpha$-$Al_2O_3$. This fact implies that the cavity faces are virtually incapable of reacting with the molten super alloy. The data show that the investment shell molds manufactured by the present invention are suitable for the production of super alloys.

When a Ni-based super alloy of the aforementioned composition was cast in the investment shell molds of this invention under the conditions of 55° C./cm of temperature gradient and 60 mm/H of solidifying speed to produce grain-oriented solidified castings, changes in molten alloy composition were very slight. Consequently, there were obtained grain-oriented solidified castings of good quality showing no sign of casting defect due to reaction with the molten alloy composition.

What is claimed is:

1. A method for the manufacture of an investment shell mold by the steps of applying to the surface of a pattern of a soluble or inflammable substance slurries containing refractory substances thereby forming a coating of said slurries on the pattern, causing said coating to set and, after said coating has set, removing said pattern, which method is characterized by forming said coating by first applying to the surface of said pattern at least one layer of a slurry obtained by dissolving in an organic solvent solution of an organic soluble cellulose derivative the powder of the oxide of at least one element selected from the group consisting of magnesium, aluminum, zirconium, hafnium, yttrium, calcium, lanthanum, cesium, barium, and silicon and subsequently applying to said first layer at least one layer of a slurry formed by mixing a refractory powder and a refractory binder.

2. A method according to claim 1, wherein said oxide is a complex oxide containing Si.

3. A method according to claim 1, wherein said organic soluble cellulose derivative is one member selected from the group consisting of ethyl cellulose having an ethoxy group content of 43 to 50% and methyl cellulose having a methoxy group content of 38 to 43%.

* * * * *

UNITED STATES PATENT AND TRADEMARK OFFICE

CERTIFICATE OF CORRECTION

PATENT NO. : 4,557,316

DATED : December 10, 1985

INVENTOR(S) : Takayanagi, Takeshi

It is certified that error appears in the above-identified patent and that said Letters Patent is hereby corrected as shown below:

Title page:

--The priority information in this Letters Patent has been omitted. Please add the following priority number to the Letters Patent:

58-120497 JAPAN 1/July/1983--

Signed and Sealed this

*Twenty-fifth* Day of *February 1986*

[SEAL]

*Attest:*

DONALD J. QUIGG

*Attesting Officer*

*Commissioner of Patents and Trademarks*